US009662659B2

(12) United States Patent
Kim et al.

(10) Patent No.: US 9,662,659 B2
(45) Date of Patent: May 30, 2017

(54) FOOD WASTE DISPOSAL

(71) Applicant: LG ELECTRONICS INC., Seoul (KR)

(72) Inventors: Sungmin Kim, Seoul (KR); Jongseok Kim, Seoul (KR); Sunki Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 151 days.

(21) Appl. No.: 14/624,658

(22) Filed: Feb. 18, 2015

(65) Prior Publication Data

US 2015/0231639 A1 Aug. 20, 2015

(30) Foreign Application Priority Data

Feb. 20, 2014 (KR) ..... 10-2014-0019592

(51) Int. Cl.

| | |
|---|---|
| ***B02C 23/10*** | (2006.01) |
| ***B02C 18/00*** | (2006.01) |
| ***E03C 1/266*** | (2006.01) |
| ***F26B 5/08*** | (2006.01) |

(52) U.S. Cl.

CPC ..... *B02C 18/0092* (2013.01); *B02C 23/10* (2013.01); *E03C 1/2665* (2013.01); *F26B 5/08* (2013.01)

(58) Field of Classification Search

CPC ..... B02C 18/0092; B02C 23/10; B02C 23/36; E03C 1/2665; F26B 5/08

See application file for complete search history.

(56) References Cited

U.S. PATENT DOCUMENTS 2,939,639 A * 6/1960 Coss ..... E03C 1/2665 181/208
7,886,563 B2 * 2/2011 Komori ..... D06F 25/00 68/18 C

FOREIGN PATENT DOCUMENTS

KR 10-1104573 * 1/2012
KR 10-1168557 * 7/2012

* cited by examiner

*Primary Examiner* — Mark Rosenbaum
(74) *Attorney, Agent, or Firm* — Fish & Richardson P.C.

(57) ABSTRACT

A food waste disposal includes a grinding part configured to grind food waste, a dewatering part configured to receive the ground food waste from the grinding part and to discharge water out of the received food waste, and a connecting frame having a rotating shaft. The dewatering part is rotatably coupled to the connecting frame via the rotating shaft. Further, the dewatering part is configured to be rotated vertically downward away from the grinding part in a top/bottom direction around the rotating shaft.

20 Claims, 5 Drawing Sheets

FOOD WASTE DISPOSAL

Pursuant to 35 U.S.C. §119(a), this application claims the benefit of earlier filing date and right of priority to Korean Application No. 10-2014-0019592, filed on Feb. 20, 2014, the contents of which are hereby incorporated by reference herein in their entirety.

BACKGROUND OF THE INVENTION

Field of the Invention

The present invention relates to a food waste disposal. Although the present invention is suitable for a wide scope of applications, it is particularly suitable for grinding food waste, dewatering and drying the ground food waste, and then discharging the dried food waste. More particularly, the present invention relates to a food waste disposal having a dewatering tub for dewatering and drying food waste. The dewatering tub can be tilted in a top/bottom direction. While the dewatering tub inclines downward at a prescribed angle (i.e., the dewatering tub is tilted), the food waste can be discharged.

Discussion of the Related Art

Generally, since food waste remaining after consumed in a home or restaurant contains a considerable amount of water, if the food waste is not processed immediately, a drainer of a sink and a drainage hole connected to the drainer can be clogged. Specifically, if such food waste is introduced into a sewage way, it may cause water pollution.

If water is not removed from the food waste, the weight of the food waste increases. Moreover, if the water contained food waste spoils, a considerable amount of leachate is generated together with bad smell. Hence, environmental pollution may be triggered.

In order to solve the above problems, various food waste disposals for removing water from food waste and drying the dewatered food waste have been proposed.

For instance, Korean Publication of Unexamined Patent Application No. 2010-0044395 discloses a food waste disposal for grinding, dewatering and discharging food waste with a single motor.

However, since the food waste disposal disclosed in Korean Publication of Unexamined Patent Application No. 2010-0044395 has a space for dewatering separated from a space for drying, it may cause a problem that the food waste disposal is structurally complicated and spatially limited.

For another instance, Korean Publication of Unexamined Patent Application No. 2010-0044396 discloses a food waste disposal having a lower drum configured to operate up and down by a cam and an upper drum configured to be driven by friction with the lower drum.

However, the food waste disposal disclosed in Korean Publication of Unexamined Patent Application No. 2010-0044396 has the following problems. First of all, it is impossible to dry food waste within a drum (i.e., a separate drying space is required). Secondly, since viscous food waste is attached to an inner wall of the drum, it is not smoothly discharged.

SUMMARY OF THE INVENTION

Accordingly, embodiments of the present invention are directed to a food waste disposal that substantially obviates one or more problems due to limitations and disadvantages of the related art.

One object of the present invention is to provide a food waste disposal, by which food waste can be dewatered and dried within a single dewatering part.

Another object of the present invention is to provide a food waste disposal as follows. First of all, a dewatering part is configured to be tilted in top/bottom directions (i.e., vertical direction). Secondly, while the dewatering part is tilted at a prescribed angle in the top/bottom direction, a dewatering tub provided to the dewatering part is rotated to discharge food waste.

Further object of the present invention is to provide a food waste disposal, in which an agitator configured to be rotated together with or separately from a dewatering tub is provided within a dewatering part, thereby facilitating a discharge of the dewatered and dried food waste.

Technical tasks obtainable from the present invention are non-limited by the above-mentioned technical tasks. And, other unmentioned technical tasks can be clearly understood from the following description by those having ordinary skill in the technical field to which the present invention pertains.

Additional advantages, objects, and features of the invention will be set forth in the disclosure herein as well as the accompanying drawings. Such aspects may also be appreciated by those skilled in the art based on the disclosure herein.

To achieve these objects and other advantages and in accordance with the purpose of the invention, as embodied and broadly described herein, a food waste disposal according to one embodiment of the present invention may include a grinding part configured to grind a food waste, a dewatering part disposed to receive the ground food waste from the grinding part, and a connecting frame having a rotating shaft rotatably connected to the dewatering part, wherein the dewatering part is rotated in a top/bottom direction around on the rotating shaft.

Preferably, the food waste disposal may further include a $1^{st}$ motor provided to the connecting frame, the $1^{st}$ motor providing a driving force to rotate the dewatering part.

Preferably, the dewatering part may include a $1^{st}$ dewatering tub connected rotationally in the top/bottom direction around on the rotating shaft, a $2^{nd}$ dewatering tub provided rotationally within the $1^{st}$ dewatering tub, the $2^{nd}$ dewatering tub having a plurality of dewatering holes formed on an outer circumferential surface of the $2^{nd}$ dewatering tub, the $2^{nd}$ dewatering tub configured to receive the ground food waste therein, and a $2^{nd}$ motor connected to a bottom surface of the $2^{nd}$ dewatering tub to rotate the $2^{nd}$ dewatering tub by penetrating a bottom surface of the $1^{st}$ dewatering tub.

Preferably, a communicating hole configured to make the grinding part and the dewatering part communicate with each other may be formed in the connecting frame.

More preferably, the connecting frame may include a middle frame disposed horizontally over the $1^{st}$ dewatering tub and two lateral frames extending downward from both end portions of the middle frame. And, the communication hole may be formed in the middle frame.

Moreover, both of the end portions of the lateral frame may be disposed on an outer lateral surface of the $1^{st}$ dewatering tub to oppose each other and the rotating shaft may be provided between the outer lateral surface of the $1^{st}$ dewatering tub and both of the end portions of the lateral frame in order for the $1^{st}$ dewatering tub to be rotated around on the rotating shaft.

More preferably, a $1^{st}$ opening may be formed on one side of the $1^{st}$ dewatering tub to receive the $2^{nd}$ dewatering tub therein, a $2^{nd}$ opening may be formed on one side of the $2^{nd}$ dewatering tub to receive the ground food waste, and an edge portion forming a circumference of the $1^{st}$ opening may be curved.

And, the edge portion of the $1^{st}$ opening may include a pair of protrusions configured to oppose each other and a pair of recesses configured to oppose each other between a pair of the protrusions.

Moreover, when the ground food waste is dewatered, as the $2^{nd}$ dewatering tub within the $1^{st}$ dewatering tub is rotated in a state that the $1^{st}$ opening and the $2^{nd}$ opening face upward, water may be removed from the ground food waste. Besides, when the water removed food waste is discharged, as the $1^{st}$ dewatering tub is rotated downward at a prescribed angle and the $2^{nd}$ dewatering tub within the $1^{st}$ dewatering tub is rotated, the water removed food waste may be discharged.

Preferably, the food waste disposal may further include a hot air supplying part configured to supply a hot air into the dewatering part.

Preferably, an agitator configured to agitate the food waste may be rotationally provided within the dewatering part.

More preferably, the dewatering part may include a $1^{st}$ dewatering tub connected rotationally in the top/bottom direction around on the rotating shaft and a $2^{nd}$ dewatering tub provided rotationally within the $1^{st}$ dewatering tub, the $2^{nd}$ dewatering tub having a plurality of dewatering holes formed on an outer circumferential surface of the $2^{nd}$ dewatering tub, the $2^{nd}$ dewatering tub configured to receive the ground food waste therein. And, the agitator may be provided within the $2^{nd}$ dewatering tub.

Moreover, the agitator may include a bottom rib extending from a center of a bottom surface of the $2^{nd}$ dewatering tub in a radius direction and a lateral rib extending from both end portions of the bottom rib along an inner circumferential surface of the $2^{nd}$ dewatering tub toward an opening of the $2^{nd}$ dewatering tub.

In this case, the lateral rib may be curved at a prescribed angle.

Besides, the agitator may be rotated in a direction equal to or different from a rotational direction of the $2^{nd}$ dewatering tub.

In another aspect of the present invention, as embodied and broadly described herein, a food waste disposal according to another embodiment of the present invention may include a food waste dewatering part having an opening configured to receive a food waste therein and a drainage hole configured to discharge water from the food waste and a connecting frame disposed over the dewatering part, the connecting frame having a communicating hole configured to communicate with the opening, a rotating shaft connected rotationally to the dewatering part and a $1^{st}$ motor configured to rotate the rotating shaft, wherein the dewatering part is rotated in top/bottom direction around on the rotating shaft by driving the $1^{st}$ motor.

Preferably, the dewatering part may include a $1^{st}$ dewatering tub connected rotationally in the top/bottom direction around on the rotating shaft, a $2^{nd}$ dewatering tub provided rotationally within the $1^{st}$ dewatering tub, the $2^{nd}$ dewatering tub having a plurality of dewatering holes formed on an outer circumferential surface of the $2^{nd}$ dewatering tub, the $2^{nd}$ dewatering tub configured to receive the ground food waste therein, and a $2^{nd}$ motor connected to a bottom surface of the $2^{nd}$ dewatering tub to rotate the $2^{nd}$ dewatering tub by penetrating a bottom surface of the $1^{st}$ dewatering tub.

More preferably, the food waste disposal may further include a hot air supplying part configured to supply a hot air into the dewatering part.

And, before the dewatering part is rotated around on the rotating shaft, a dewatering operation of the food waste received in the dewatering part by a rotation of the $2^{nd}$ dewatering tub and a drying operation of the food waste by the hot air may be performed. Moreover, after the dewatering tub has been rotated around on the rotating shaft, a discharging operation of the food waste received in the dewatering part may be performed.

More preferably, an agitator configured to agitate the food waste may be rotationally provided within the dewatering part.

Accordingly, embodiments of the present invention provide various effects and/or features.

First of all, since a food waste disposal according to the present invention is able to dewater and dry food waste ground by a food waste grinding part within a single dewatering part, thereby being structurally simplified without spatial limitations.

Secondly, the dewatering part can be tilted in top/bottom direction (i.e., vertical direction). While the dewatering part is tilted at a prescribed angle in the top/bottom direction, since food waste can be discharged by rotating a dewatering tub provided to the dewatering part, the dewatered food waste can be easily discharged.

Thirdly, an agitator configured to be rotated together with or separately from the dewatering tub is provided within the dewatering part, thereby facilitating a discharge of the dewatered and dried food waste.

Effects obtainable from the present invention may be non-limited by the above mentioned effect. And, other unmentioned effects can be clearly understood from the following description by those having ordinary skill in the technical field to which the present invention pertains.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. The above and other aspects, features, and advantages of the present invention will become more apparent upon consideration of the following description of preferred embodiments, taken in conjunction with the accompanying drawing figures. In the drawings.

DETAILED DESCRIPTION OF THE INVENTION

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

Figure 1:
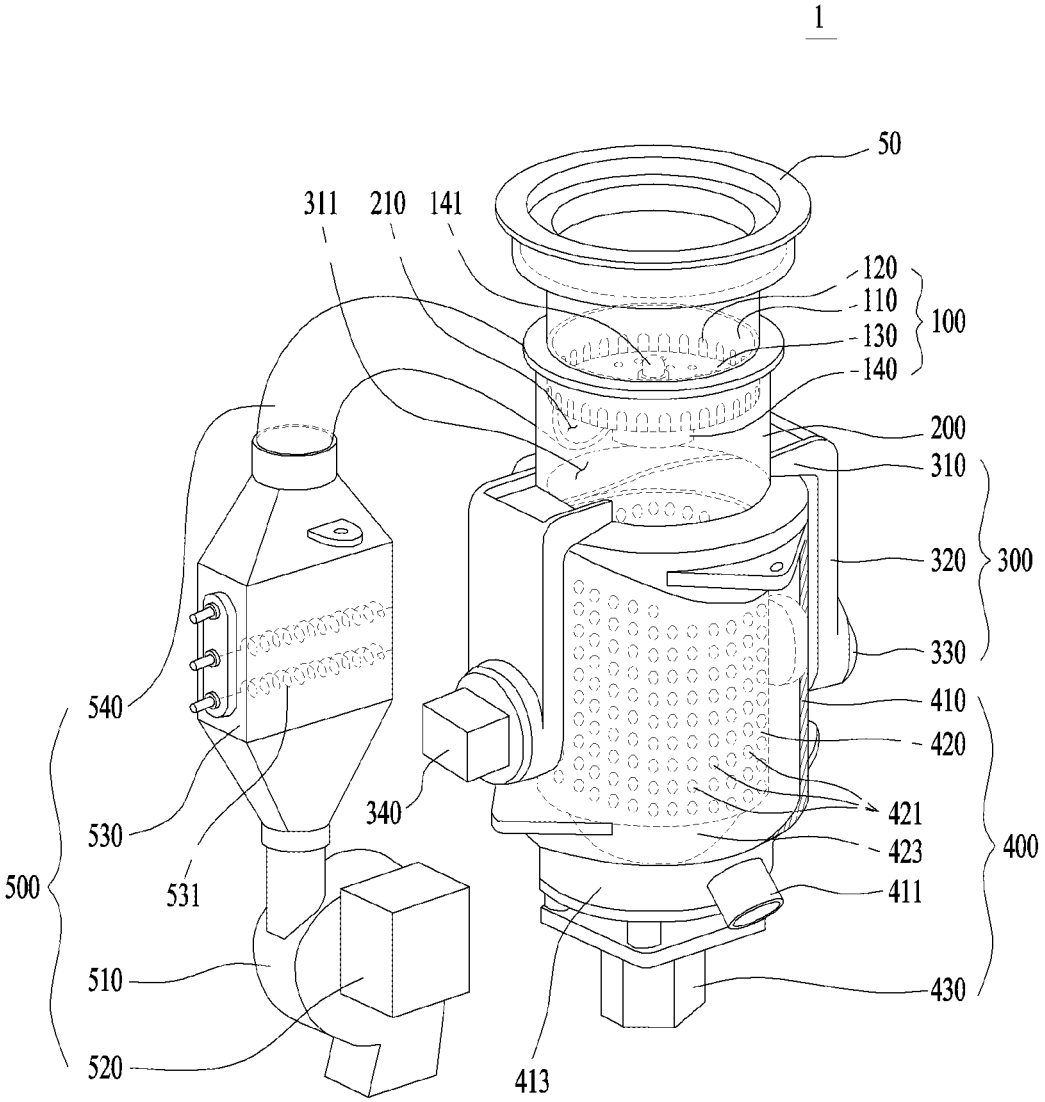
FIG. 1 is a perspective diagram of a food waste disposal according to the present invention.

FIG. 1 is a perspective diagram of a food waste disposal according to the present invention. Particularly, FIG. 1 is a perspective diagram to describe a state that a portion of a 1$^{st}$ dewatering tub is cut to expose a 2$^{nd}$ dewatering tub disposed within the 1$^{st}$ dewatering tub in a food waste disposal according to the present invention. The food waste disposal can be used in a manner of being installed by being inserted in a lower part of a sink used at home or restaurant [i.e., built-in type] or being installed within a separate casing (not shown in the drawing) configured separate from the sink.

Referring to FIG. 1, a food waste disposal according to the present invention may include a grinding part 100 configured to grind food waste, a food waste dewatering part 400 disposed to be provided with the food waste ground by the food waste grinding part 100, the food waste dewatering part 400 having a drainage hole 411 configured to discharge water out of the ground food waste, and a connecting frame 300 disposed between the grinding part 100 and the dewatering part 400, the connecting frame 300 having a 1$^{st}$ motor 340 and a rotating shaft 330. As the rotating shaft 300 is rotatably connected to the dewatering part 400, the dewatering part 400 can be tilted in top/bottom direction by the 1$^{st}$ motor 340 around on the rotating shaft 330. In particular, while the connecting frame 300 itself is fixed not to move, the dewatering part 400 can be tilted in the top/bottom direction around on the rotating shaft 330 by the 1$^{st}$ motor 340 provided to the connecting frame 300 and the rotating shaft 330 provided between the connecting frame 300 and the dewatering part 400.

In doing so, the 1$^{st}$ motor 340 may be supplied with power from an external power source (not shown in the drawing) or a battery (not shown in the drawing) built in the 1$^{st}$ motor 340. Alternatively, while the food waste grinding part 100 is not provided, the food waste dewatering part 400 and the connecting frame 300 connected to enable the food waste dewatering part 400 to be tilted may be included only. The reason for this is not to exclude a case that food waste is directly dewatered or dried without being ground.

The dewatering part 400 may include a 1$^{st}$ dewatering tub 410, a 2$^{nd}$ dewatering tub 420 provided rotationally within the 1$^{st}$ dewatering tub 410, and a 2$^{nd}$ motor 430 configured to rotate the 2$^{nd}$ dewatering tub 420.

Moreover, a plurality of dewatering holes 421 are formed on an outer circumferential surface of the 2$^{nd}$ dewatering tub 420. The 2$^{nd}$ motor 430 can be connected to a bottom surface 423 of the 2$^{nd}$ dewatering tub 420 by penetrating a bottom surface 413 of the 1$^{st}$ dewatering tub 410. For instance, a rotating shaft (not shown in the drawing) of the 2$^{nd}$ motor 430 can be connected to the bottom surface 423 of the 2$^{nd}$ dewatering tub 420 by penetrating the bottom surface 413 of the 1$^{st}$ dewatering tub 410. In this case, a portion of the bottom surface 413 of the 1$^{st}$ dewatering tub 410, which is penetrated by the rotating shaft of the 2$^{nd}$ motor 430, can be sealed with a sealing member (not shown in the drawing) and/or the like. In order to attenuate the vibration of the 1$^{st}$ dewatering tub 410 due to the driven 2$^{nd}$ motor 430, it is preferable that the sealing member is formed of an elastic material such as rubber or the like.

According to the above-described configuration, if the 2$^{nd}$ dewatering tub 420 is rotated by the 2$^{nd}$ motor 430, water contained in the ground food waste received in the 2$^{nd}$ dewatering tub 420 can be discharged through the dewatering holes 421. For instance, the water passing through the dewatering holes 421 flows down along a space between an inner wall of the 1$^{st}$ dewatering tub 410 or an outer circumferential surface of the 2$^{nd}$ dewatering tub 420 and an inner circumferential surface of the 1$^{st}$ dewatering tub 410 and can be then discharged externally through the drainage hole 411 provided to a bottom side of the 1$^{st}$ dewatering tub 410.

In doing so, the 2$^{nd}$ motor 420 may be supplied with a power from an external power source (not shown in the drawing) or a battery (not shown in the drawing) built in the 2$^{nd}$ motor 420.

The connecting frame 300 may be disposed over the dewatering part 400. For instance, the connecting frame 300 may be disposed between the dewatering part 400 and the grinding part 100.

In particular, the connecting frame 300 may include a middle frame 310 disposed horizontally over the 1$^{st}$ dewatering tub 410 and a pair of lateral frames 320 extending respectively from both end portions of the middle frame 310. In this case, the middle frame 310 and the lateral frame 320, which configure the connecting frame 300, may be formed in one body. Moreover, the lateral frames 32 may extend vertically downward along the outer circumferential surface of the 1$^{st}$ dewatering tub 410 from both of the end portions of the middle frame 310. A communicating hole 311 may be formed in the middle frame 310 to enable the grinding part 100 and the dewatering part 400 to communicate with each other. Hence, the food waste ground by the grinding part 100 can enter the dewatering part 400, and more particularly, the 2$^{nd}$ dewatering tub 420 through the communicating hole 311. In particular, the food waste ground by the grinding part 100 is received in the 2$^{nd}$ dewatering tub 420 to be dewatered and/or dried.

Both end portions of each of the lateral frame 320 (i.e., end portions of a pair of the lateral frames) are disposed at opposed portions of an outer lateral surface of the 1$^{st}$ dewatering tub 410, respectively and the rotating shaft 300 can be provided between both of the end portions of the lateral frame 320 and the outer lateral surface of the 1$^{st}$ dewatering tub 410. And, the 1$^{st}$ motor 340 may be provided to at least one of both of the end portions of the lateral frame 320. Optionally, the 1$^{st}$ motor 340 may be provided to the end portion of each of a pair of the lateral frames 320. Hence, if the 1$^{st}$ motor 340 is driven, the 1$^{st}$ dewatering tub 410 can be tilted around on the rotating shaft 330. For instance, if the 1$^{st}$ motor 340 rotates the rotating shaft 330, the 1$^{st}$ dewatering tub 410 and the 2$^{nd}$ dewatering tub 420 rotationally provided within the 1$^{st}$ dewatering tub 410 can be tilted in top/bottom direction (i.e., vertically) around on the rotating shaft 330.

In this case, if the 1$^{st}$ motor 340 is provided to the end portion of one of a pair of the lateral frames 320, the end portion of the other may be coupled with the 1$^{st}$ dewatering tub 410 using the rotating shaft 330 as a coupling medium so as to be rotated by the 1$^{st}$ motor 340.

Meanwhile, the food waste disposal according to the present invention may further include a hot air supplying part 500 configured to supply hot air into the dewatering part 400. The hot air supplying part 500 may include a fan 510 configured to supply an external air into the dewatering part 400 by sucking the external air, a 3$^{rd}$ motor 520 configured to rotate the fan 510, and a heater 530 configured to heat the air supplied into the dewatering part 400 by the fan 510.

Preferably, the heater 530 may have a heating coil 531 provided therein. Alternatively, any heaters capable of heating the external air can be used as the heater 530. Hence, the air sucked in by the fan 510 is seated while passing through the heater 530. The heated air can be supplied into the dewatering part 400 through a hot air supply pipe 540. In particular, after the food waste has been dewatered by the dewatering part 400, the dewatered food waste can be dried by driving the hot air supplying part 500. In doing so, a user may activate one of a dewatering function and a drying function. Alternatively, the user may be able to activate the dewatering function and the drying function sequentially. Moreover, one end of the hot air supply pipe 540 may be connected to the heater 530, while the other end of the hot air supply pipe 540 may be connected to a hot air supply hole 210 formed on one side of a connecting pipe 200 that will be described in the following.

The hot air supplying part 500 may be supplied with a power from an external power source (not shown in the drawing) or a battery (not shown in the drawing) built in the hot air supplying part 500. In particular, the fan 510, the $3^{rd}$ motor 520 and the heater 530, which are included in the hot air supplying part 500, may be supplied with a power from an external power source (not shown in the drawing). Alternatively, the fan 510, the $3^{rd}$ motor 520 and the heater 530, which are included in the hot air supplying part 500, may be supplied with powers from batteries (not shown in the drawing) built in the fan 510, the $3^{rd}$ motor 520 and the heater 530, respectively.

Figure 2:
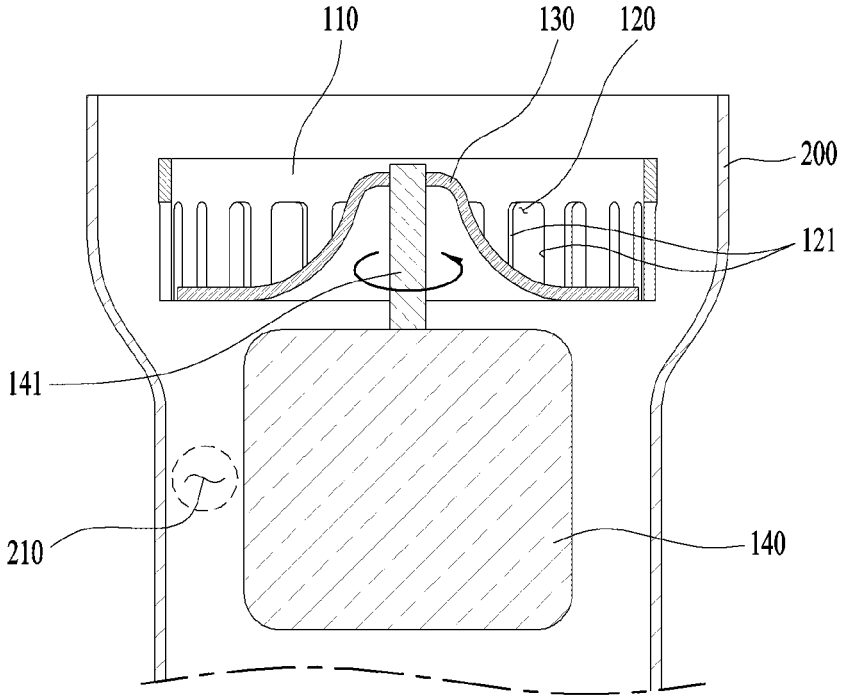
FIG. 2 is a cross-sectional diagram of a food waste grinding part.

FIG. 2 is a cross-sectional diagram of the food waste grinding part of the food waste disposal according to one embodiment of the present invention.

Referring to FIG. 1 and FIG. 2, the grinding part 100 may include a grinding frame 110 of a cylinder type having one side open, a disk rotationally installed within the grinding frame 110, and a $4^{th}$ motor 140 connected to the disk 130 by penetrating a bottom portion of the grinding frame 110. For instance, the $4^{th}$ motor 140 includes a shaft 141. And, the disk 130 can be connected to the $4^{th}$ motor 140 through the shaft 141 that penetrates the bottom portion of the grinding frame 110. An inlet flange 50 may be installed over the grinding frame 100 to partition an inlet of the food waste. In this case, the $4^{th}$ motor 140 may be supplied with a power from an external power source (not shown in the drawing) or a battery (not shown in the drawing) built in the $4^{th}$ motor 140.

A plurality of cutter holes 120 differing from each other in size may be formed in the grinding frame 100 along an outer circumferential surface of the grinding frame 100. And, a cutter blade 121 may be formed on an edge portion of each of the cutter holes 120. Hence, if the disk 130 is rotated by the $4^{th}$ motor 140, the food waste received in the grinding frame 110 is ground by the cutter blades 121 owing to a centrifugal force. Subsequently, the ground food waste can be discharged from the grinding frame 110 through the cutter holes 120.

The grinding part 100 may be disposed over the dewatering part 400. In particular, the middle frame 310 may have the connecting pipe 200 extending from an edge portion of the communicating hole 311. And, the grinding part 100 may be disposed at an upper part within the connecting pipe 200. The connecting pipe 200 may have a configuration of a cylinder type. And, a hot air supply hole 210 connected to the hot air supply pipe 540 may be formed on one lateral surface of the connecting pipe 200. In this case, the connecting pipe 200 may be formed in one body with the connecting frame 300. Moreover, a diameter of an inner circumferential surface of the connecting pipe 200 may be preferably formed to be greater than that of an outer circumferential surface of the grinding frame 110. In particular, a gap may be formed between the inner circumferential surface of the connecting pipe 200 and the outer circumferential surface of the grinding frame 110.

Hence, the ground food waste discharged out of the grinding frame 110 through the cutter holes 120 falls down along the space between an outer side of the grinding frame 110 and the connecting pipe 200 owing to gravity, passes through the communicating hole 311 of the connecting frame 300, and then falls into the dewatering part 400.

Although the grinding part 100 of the present invention is mentioned in the above description, any other grinding parts known to the public are applicable to the food waste disposal according to the present invention as well as the above-described grinding part 100. In particular, the present invention is characterized in including a tiltable dewatering part. Hence, a configuration of a grinding part may employ configurations of any grinding parts capable of grinding food waste. For instance, in order to raise a grinding efficiency of food waste received in a grinding part, at least one rotational cutter (not shown in the drawing) can be provided within the grinding part.

Figure 3A:
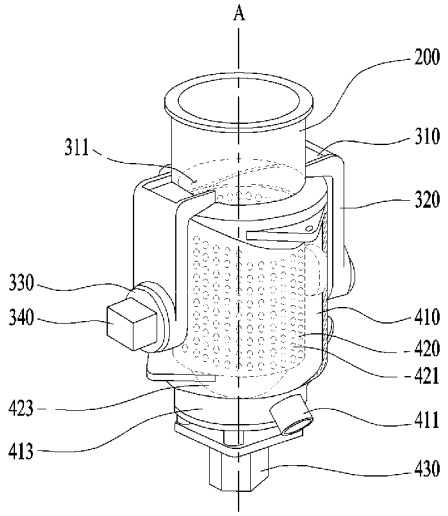
FIG. 3A is a perspective diagram of a dewatering part before tilted in top/bottom direction.
Figure 3B:
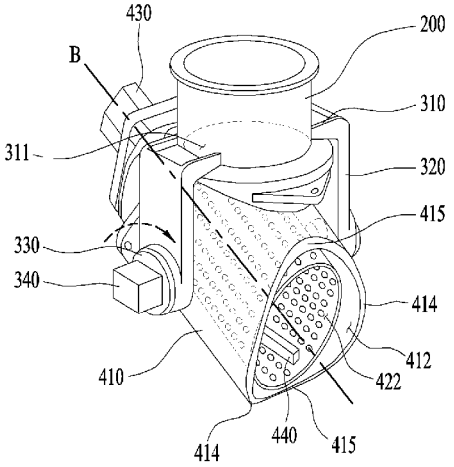
FIG. 3B is a perspective diagram of a dewatering part after tilted in top/bottom direction.

FIG. 3A is a perspective diagram of a dewatering part before tilted in top/bottom direction, and FIG. 3B is a perspective diagram of a dewatering part after tilted in top/bottom direction. Particularly, FIG. 3A shows a state that a $1^{st}$ dewatering tub is cut in part to expose a $2^{nd}$ dewatering tub.

Referring to FIG. 3A and FIG. 3B, a dewatering part 400 includes openings 412 and 422 to receive a food waste. In particular, a $1^{st}$ opening 412 may be formed on one side of a $1^{st}$ dewatering tub 410 to receive a $2^{nd}$ dewatering tub 420. And, a $2^{nd}$ opening 422 may be formed on one side of the $2^{nd}$ dewatering tub 420 to receive a ground food waste. In this case, the $1^{st}$ opening 412 and the $2^{nd}$ opening 422 may be formed on the same lateral surface. In particular, while the dewatering part 400 is not tilted in top/bottom direction, both of the $1^{st}$ opening 412 and the $2^{nd}$ opening 422 may be disposed toward a top side [cf. FIG. 3A].

Referring to FIG. 3A, the dewatering part 400 shown in FIG. 3A is not tilted. And, the $1^{st}$ opening 412 of the $1^{st}$ dewatering tub 410 and the $2^{nd}$ opening 422 of the $2^{nd}$ dewatering tub 420 are disposed toward a communicating hole 311 formed at a connecting frame 300. A $2^{nd}$ motor 430 configured to rotate the $2^{nd}$ dewatering tub 420 is disposed on a most bottom side (i.e., under the $1^{st}$ dewatering tub 410). In particular, the $1^{st}$ dewatering tub 410, the $2^{nd}$ dewatering tub 420 and the $2^{nd}$ motor 430 are disposed in one line along an axis 'A' shown in FIG. 3A (hereinafter, the state shown in FIG. 3A shall be named 'pre-tilted state').

In the pre-tilted state, the ground food waste can be received in the $2^{nd}$ dewatering tub 420 through the communicating hole 311. In doing so, if the $2^{nd}$ dewatering tub 420 is rotated by the $2^{nd}$ motor 430, water contained in the food waste received in the $2^{nd}$ dewatering tub 420 can be discharged out of the $2^{nd}$ dewatering tub 420 through dewatering holes 421 formed on an outer circumferential surface of the $2^{nd}$ dewatering tub 420 owing to a centrifugal force. The water discharged out of the $2^{nd}$ dewatering tub 420 flows down along an inner circumferential surface of the $1^{st}$ dewatering tub 410 (i.e., through a space between the outer circumferential surface of the $2^{nd}$ dewatering tub 420 and the inner circumferential surface of the $1^{st}$ dewatering tub 410) and is then discharged externally through the drainage hole 411.

Moreover, in response to a user's selection, it is able to activate the hot air supplying part 500 shown in FIG. 1 in order to dry the dewatered food waste. Of course, after the ground food waste has been dewatered, it may be able to set the drying to be automatically performed.

Preferably, the supply of the hot air by the hot air supplying part 500 may be performed in the pre-tilted state. In particular, in the pre-tilted state, after the food waste received in the $2^{nd}$ dewatering tub 420 has been dewatered by the rotation of the $2^{nd}$ dewatering tub 420, the drying of the food waste received in the $2^{nd}$ dewatering tub 420 can be performed by the supply of the hot air by the hot air supplying part 500. In doing so, while the food waste is dewatered, an RPM of the $1^{st}$ dewatering tub 410 is equal to or greater than that of the $1^{st}$ dewatering tub 410. The RPM of the $1^{st}$ dewatering tub 410 can be controlled by a controller (not shown in the drawing). And, it is preferable that the RPM of the $1^{st}$ dewatering tub 410 on dewatering the food waste and the RPM of the $1^{st}$ dewatering tub 410 on drying the food waste are set in the controller in advance.

Referring to FIG. 3B, the dewatering part shown in FIG. 3B is in a tilted state. The $1^{st}$ opening 412 of the $1^{st}$ dewatering tub 410 and the $2^{nd}$ opening 422 of the $2^{nd}$ dewatering tub 420 are disposed by being misaligned with the communicating hole 311 formed in the connecting frame 300. In particular, the dewatering part 400 including the $1^{st}$ dewatering tub 410, the $2^{nd}$ dewatering tub 420 and the $2^{nd}$ motor 430 can be tilted downward around on the rotating shaft 330. For instance, as the rotating shaft 330 is rotated clockwise, the dewatering part 400 including the $1^{st}$ dewatering tub 410, the $2^{nd}$ dewatering tub 420 and the $2^{nd}$ motor 430 can be rotated clockwise as well.

In particular, by the rotating shaft 330 provided between the connecting frame 300 and the dewatering part 400 and the $1^{st}$ motor 340 provided to the connecting frame 300 to rotate the rotating shaft 330, the dewatering part 400 can be tilted clockwise around on the rotating shaft 330. As mentioned in the foregoing description, the connecting frame 300 includes a middle frame 310 and a pair of lateral frames 320 and the dewatering part 400 (i.e., the $1^{st}$ dewatering tub 410) is disposed between a pair of the lateral frames 320. The lateral frame 320 and an outer circumferential surface of the $1^{st}$ dewatering tub 410 are connected to each other by the rotating shaft 330. And, the rotating shaft 330 can be rotated by the $1^{st}$ motor 340. Hence, by driving the $1^{st}$ motor 340, the whole dewatering part 400 can be tilted clockwise (or, in top/bottom direction). According to the embodiment shown in the drawing, the dewatering part 400 can be tilted downward over 90 degrees around on the rotating shaft 300 in the pre-tilted state.

In this case, the $1^{st}$ opening 412 of the $1^{st}$ dewatering tub 410 and the $2^{nd}$ opening 422 of the $2^{nd}$ dewatering tub 420 can be disposed in one line along an axis 'B' shown in FIG. 3B. The axis 'B' can be tilted clockwise or downward at 90 to 130 degrees in comparison with the axis 'A' shown in FIG. 3A. Preferably, the axis 'B' is tilted at 100 degrees. In this state, the $1^{st}$ opening 412 and the $2^{nd}$ opening 422 may be located at the same height of the $2^{nd}$ motor 430, or the $2^{nd}$ motor 430 will be located over the $1^{st}$. opening 412 and the $2^{nd}$ opening 422 (hereinafter, the state shown in FIG. 3B shall be named 'tilted state').

In this tilted state, the ground food waste received in the $2^{nd}$ dewatering tub 420 can be discharged through the $2^{nd}$ opening 422. In particular, the completely dewatered and/or dried food waste in the $2^{nd}$ dewatering tub 420 can be externally discharged through the $2^{nd}$ opening 422.

In particular, in the tilted state, while the $2^{nd}$ dewatering tub 420 is rotated, the food waste can be discharged externally through the $2^{nd}$ opening 422.

In this case, an agitator 440, which can be rotated to agitate and discharge food waste, may be provided within the $2^{nd}$ dewatering tub 420. The agitator 440 may be rotate in a direction equal to or different from that of the $2^{nd}$ dewatering tub 420. Hence, in the tilted state, owing to the rotations of the $2^{nd}$ dewatering tub 420 and the agitator 440, efficiency in discharging the dewatered and/or dried food waste from the $2^{nd}$ dewatering tub 420 can be raised. In particular, in the tilted state, the agitator 440 in the $2^{nd}$ dewatering tub 420 is rotated so that the food waste in the $2^{nd}$ dewatering tub 420 can be externally discharged. Moreover, it is possible to externally discharge the food waste in the $2^{nd}$ dewatering tub 420 in a manner of rotating the $2^{nd}$ dewatering tub 420 only without rotating the agitator 440. Configuration of the agitator 440 shall be described in detail with reference to other drawings later.

Meanwhile, an edge portion configuring a circumference of the $1^{st}$. opening 412 formed on the $1^{st}$ dewatering tub 410 is preferably curved. In particular, the edge portion partitioning the circumference of the $1^{st}$ opening 412 is curved. In more particular, the edge portion of the $1^{st}$ opening 412 may include a pair of protrusions 414 configured to face each other and a pair of recesses 415 configured to face each other between a pair of the protrusions 414. In other words, in the edge portion of the $1^{st}$ opening 412, the protrusion 414 and the recess 415 can be formed alternately. Preferably, a pair of the protrusions 414 are formed to face each other and a pair of the recesses 415 are formed to face each other between a pair of the protrusions 414. In this case, a pair of the protrusions 414 are preferably formed at locations corresponding to a pair of the lateral frames 320, respectively, and the recess 415 is preferably formed at a location offset by 90 degrees from the protrusion 414 (i.e., in a tilted direction of the dewatering part 400).

Moreover, the protrusions 414 and the recesses 415 may be configured to form a smooth curve continuously. In particular, the recess 415 neighboring to the protrusion 414 may be connected to the neighboring protrusion 414 in a manner of forming a continuous curve.

When the dewatering part 400 is tilted, the above-described configuration of the $1^{st}$ opening 412 prevents a topside of the dewatering part 400 from interfering with the connecting frame 300. In particular, when the dewatering part 400 is tilted, the curved shape of the edge portion of the $2^{nd}$ opening 422 can prevent the interference between the top side of the $1^{st}$ dewatering tub 410 and the middle frame 310 of the connecting frame 300.

Meanwhile, if the dewatering and/or drying completed food waste in the $2^{nd}$ dewatering tub 420 is externally discharged through the $2^{nd}$ opening 422, the dewatering part 400 may return to the pre-tilted state. In particular, if the food waste is discharged from the $2^{nd}$ dewatering tub 420 in the tilted state of the dewatering part 40, the dewatering part 400 returns to the pre-tilted state by the driving of the $1^{st}$ motor 340 so as to be ready to receive the ground food waste coming out of the grinding part 100. Subsequently, in accordance with a user's setting or a user's operation request, it is able to perform again the dewatering and/or drying of the food waste in the dewatering part 400 in the pre-tilted state and the external discharge of the food waste from the dewatering part 400 in the tilted state. Of course, such operation may be controlled through a controller not shown in the drawing.

Figure 4A:
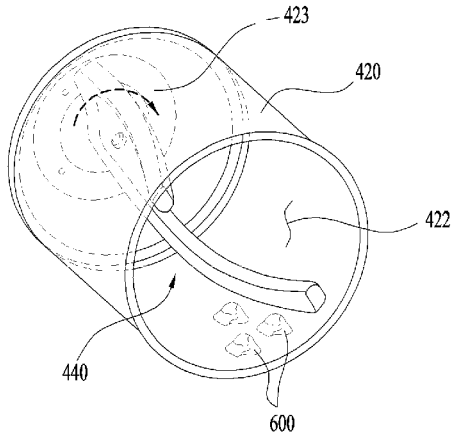
FIG. 4A and FIG. 4B are diagrams to describe operations of a $2^{nd}$ dewatering tub and an agitator provided within the $2^{nd}$ dewatering tub.
Figure 4B:
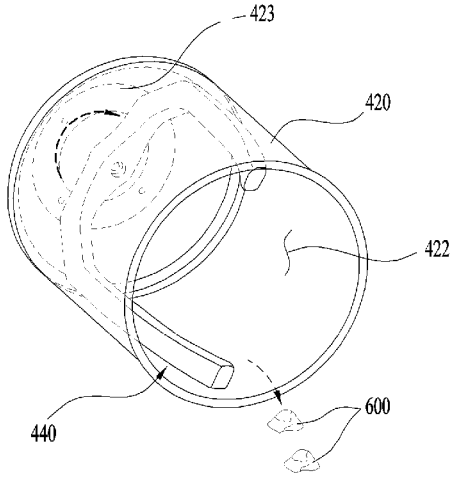

FIG. 4A and FIG. 4B are diagrams to describe operations of a $2^{nd}$ dewatering tub and an agitator rotationally provided within the $2^{nd}$ dewatering tub.

In particular, FIG. 4A and FIG. 4B are diagrams of a $2^{nd}$ dewatering tub 420 included in the dewatering part 400 and an agitator 440 in a state that the dewatering part 400 is tilted around on the rotating shaft 330. FIG. 4A shows a state that a food waste is received within the $2^{nd}$ dewatering tub. And, FIG. 4B shows a state that the food waste is discharged out of the $2^{nd}$ dewatering tub by a rotation of the agitator within the $2^{nd}$ dewatering tub.

Referring to FIG. 4A, a food waste 600 in a dewatered and/or dried state is received in the $2^{nd}$ dewatering tub 420. And, the $2^{nd}$ dewatering tub 420 received in a $1^{st}$ dewatering tub 410 is tilted (i.e., inclined) at a prescribed angle by an operation of a $1^{st}$ motor 340. Moreover, the agitator 440 is rotationally coupled with a bottom surface 423 of the $2^{nd}$ dewatering tub 420.

Referring to FIG. 4B, while the dewatering part 400 is tilted (i.e., in a tilted state), as the agitator 440 within the $2^{nd}$ dewatering tub 420 is rotated, the food waste 600 received in the $2^{nd}$ dewatering tub 420 is externally discharged through a $2^{nd}$ opening 422 of the $2^{nd}$ dewatering tub 420. In doing so, the agitator 440 within the $2^{nd}$ dewatering tub 420 can be rotated clockwise or counterclockwise. Of course, by a clutch structure not shown in the drawing, it is possible to rotate the $2^{nd}$ dewatering tub 420 only without rotating the agitator 440. Moreover, it is possible to rotate both of the $2^{nd}$ dewatering tub 420 and the agitator 400. In doing so, the $2^{nd}$ dewatering tub 420 and the agitator 440 may be rotated in the same direction. Alternatively, the $2^{nd}$ dewatering tub 420 and the agitator 440 may be rotated in the different directions, respectively. Moreover, a rotational speed of the $2^{nd}$ dewatering tub 420 may be different from that of the agitator 440.

Meanwhile, it is preferable that the $2^{nd}$ dewatering tub 420 and the agitator 440 are rotated in different directions, respectively. Yet, in case that the $2^{nd}$ dewatering tub 420 and the agitator 440 are rotated in the same direction, it may be able to raise the efficiency in agitating and discharging the food waste by differentiating a rotational speed of the $2^{nd}$ dewatering tub 420 from that of the agitator 440.

For instance, a food waste may be attached to an inner circumferential surface (i.e., an inner wall) of the $2^{nd}$ dewatering tub 420. In this case, by rotating either the agitator 440 or the $2^{nd}$ dewatering tub 420, the food waste attached to the inner circumferential surface of the $2^{nd}$ dewatering tub 420 can be easily detached from the inner circumferential surface and then discharged. Moreover, in case that the $2^{nd}$ dewatering tub 420 and the agitator 440 are simultaneously rotated, as the $2^{nd}$ dewatering tub 420 and the agitator 440 are rotated in different directions or rotated in the same direction at the different speeds, the food waste attached to the inner circumferential surface of the $2^{nd}$ dewatering tub 420 can be easily detached from the inner circumferential surface and then discharged.

The above-described rotations of the $2^{nd}$ dewatering tub 420 and the agitator 440 can be performed by the $2^{nd}$ motor 430 (cf. FIG. 1 and FIG. 3). Moreover, in order to differentiate the rotational directions or speeds of the $2^{nd}$ dewatering tub 420 and the agitator 440 from each other, a clutch structure (not shown in the drawing) can be coupled with the $2^{nd}$ motor 430. By the clutch structure, a rotational force of the $2^{nd}$ motor 430 can be delivered to the $2^{nd}$ dewatering tub 420 and the agitator 440 simultaneously or separately. In particular, by the clutch structure, the rotational force of the $2^{nd}$ motor 430 may be delivered to the $2^{nd}$ dewatering tub 420 or the agitator 440. In doing so, the rotational direction and speed of the $2^{nd}$ dewatering tub 420 may be set different from those of the agitator 440. The clutch structure includes a configuration capable of deliver a rotational force of a motor to at least two kinds of configurations simultaneously or selectively and may employ one of a multitude of clutch structures known to the public. Hence, details of the clutch structure shall be omitted from the following description.

Figure 5:
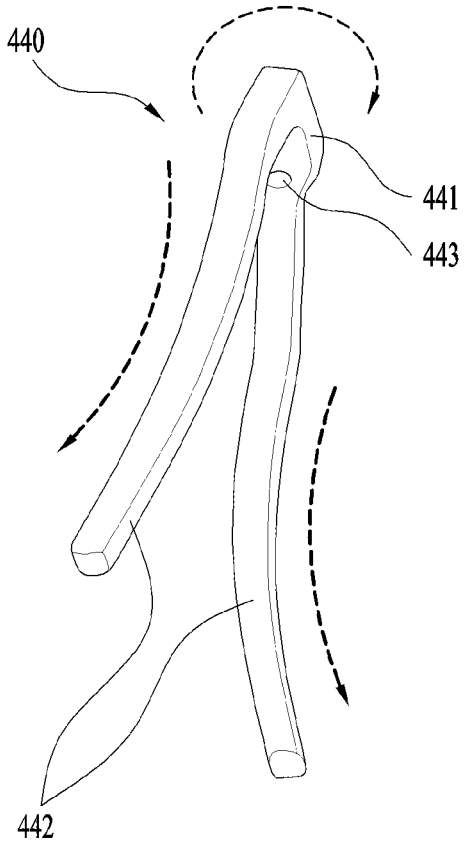
FIG. 5 is a diagram of an agitator.

Finally, FIG. 5 is a diagram of an agitator.

Referring to FIG. 4 and FIG. 5, an agitator 440 may be rotationally coupled with a bottom surface 423 of a $2^{nd}$ dewatering tub 420 within the $2^{nd}$ dewatering tub 420.

In particular, the agitator 400 may include a bottom rib 441 rotationally coupled with the bottom surface 423 of the $2^{nd}$ dewatering tub 440 and a pair of lateral ribs 441 extending from both end portions of the bottom rib 441. For instance, a coupling hole 443 is formed at a center portion of the bottom rib 441, and a fastening member (not shown in the drawing) penetrating the coupling hole 443 may be rotationally connected to the $2^{nd}$ motor 430 by penetrating the bottom surface 423 of the $2^{nd}$ dewatering tub 420. Hence, a rotational force of the $2^{nd}$ motor 430 can be delivered to the agitator 440, and more particularly, to the bottom rib of the agitator. Moreover, the bottom rib 441 may extend in a radius direction from a center of the bottom surface 423 of the $2^{nd}$ dewatering tub 420 and the lateral rib 442 may extend from both end portions of the bottom rib 441 along an inner circumferential surface of the $2^{nd}$ dewatering tub 420 toward the $2^{nd}$ opening 422 of the $2^{nd}$ dewatering tub 420.

In this case, in order to prevent a friction between the lateral rib 442 and the inner circumferential surface of the $2^{nd}$ dewatering tub 420, the lateral rib 442 may be disposed to be spaced apart in a prescribed distance from the inner circumferential surface of the $2^{nd}$ dewatering tub 420. In particular, the prescribed distance between the lateral rib 442 and the inner circumferential surface of the $2^{nd}$ dewatering tub 420 may be set enough to prevent the friction between the lateral rib 442 and the inner circumferential surface of the $2^{nd}$ dewatering tub 420. Besides, a soft member (not shown in the drawing) formed of such a flexible material as rubber or the like may be disposed between the friction between the lateral rib 442 and the inner circumferential surface of the $2^{nd}$ dewatering tub 420. In particular, in order to detach a food waste, which may be attached to the inner circumferential surface of the $2^{nd}$ dewatering tub 420, or to prevent a food waste from being stuck between friction between the lateral rib 442 and the inner circumferential surface of the $2^{nd}$ dewatering tub 420, the soft member may be attached to one lateral surface of the lateral rib 442 that opposes the inner circumferential surface of the $2^{nd}$ dewatering tub 420.

Of course, the agitator 440 may include at least two bottom ribs and at least two lateral ribs. In this case, the lateral ribs are preferably disposed to be spaced apart from each other at the same angle in a circumferential direction of the $2^{nd}$ dewatering tub 420. In particular, in case that the agitator 440 includes at least two bottom ribs and at least two lateral ribs extending from both end portions of each of the at least two bottom ribs, the lateral ribs may be disposed to be spaced apart from each other at the same angle against the inner circumferential surface of the $2^{nd}$ dewatering tub 420.

Moreover, the two lateral ribs may be configured to be curved at a prescribed angle. In particular, the two lateral ribs 442 may extend from both end portions of the bottom rib 441 in a manner of being curved clockwise or counterclockwise toward the $2^{nd}$ opening 422, respectively. For instance, the two lateral ribs 442 may be curved in the same direction or may be curved in different directions, respectively.

For instance, according to the embodiment shown in FIG. 5, regarding the two lateral ribs 442, the lateral rib disposed on an upper side may be curved clockwise and the lateral rib disposed on a lower side may be curved counterclockwise. In this case, since a phase difference between the two lateral ribs 442 is 180 degrees, when each of the lateral ribs 442 is disposed on the upper side, both of the two lateral ribs 442 are curved clockwise. Hence, the food waste in the $2^{nd}$ dewatering tub 420 can be led in a predetermined direction by a clockwise rotation of the agitator 440. Namely, referring to FIG. 4 and FIG. 5, when the lateral rib 442 is curved clockwise, if the agitator 440 is rotated clockwise, the food waste in the $2^{nd}$ dewatering tub 420 can be discharged by being led in a direction toward the $2^{nd}$ opening 422.

Hence, in order to discharge the food waste in the $2^{nd}$ dewatering tub 420 in the direction toward the $2^{nd}$ opening 422, a curved direction of the lateral rib 422 is preferably set to match the rotational direction of the agitator 440.

It will be appreciated by those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A food waste disposal comprising:

a grinding part configured to grind food waste;

a dewatering part configured to receive the ground food waste from the grinding part and to discharge water out of the received food waste; and a connecting frame having a rotating shaft, wherein the dewatering part is rotatably coupled to the connecting frame via the rotating shaft, and is configured to be rotated vertically downward away from the grinding part in a top/bottom direction around the rotating shaft.

2. The food waste disposal of claim 1, further comprising a first motor provided to the connecting frame and configured to provide a driving force to rotate the dewatering part.

3. The food waste disposal of claim 2, wherein the dewatering part comprises:

a first dewatering tub that is rotatably coupled to the connecting frame to rotate vertically downward away from the grinding part around the rotating shaft;

a second dewatering tub that is rotationally provided within the first dewatering tub, the second dewatering tub defining a plurality of dewatering holes on an outer circumferential surface of the second dewatering tub, the second dewatering tub being configured to receive the ground food waste; and a second motor coupled to a bottom surface of the second dewatering tub to rotate the second dewatering tub, the second motor coupling to the second dewatering tub through a bottom surface of the first dewatering tub.

4. The food waste disposal of claim 3, wherein the connecting frame includes a communicating hole configured to enable communication between the grinding part and the dewatering part.

5. The food waste disposal of claim 4, wherein the connecting frame comprises:

a middle frame extending in a horizontal direction and positioned vertically above the first dewatering tub; and two lateral frames extending downward from both end portions of the middle frame, wherein the communication hole is formed in the middle frame.

6. The food waste disposal of claim 5, wherein both of the end portions of the lateral frame are disposed on an outer lateral surface of the first dewatering tub in an opposing manner, and wherein the rotating shaft is provided between each of the end portions of the lateral frame and the outer lateral surface of the first dewatering tub to thereby enable the first dewatering tub to be rotated around the rotating shaft.

7. The food waste disposal of claim 3, wherein one side of the first dewatering tub includes a first opening to receive the second dewatering tub, wherein one side of the second dewatering tub includes a second opening to receive the ground food waste, and wherein an edge portion of a circumference of the first opening is curved.

8. The food waste disposal of claim 7, wherein the edge portion of the first opening includes:

a pair of protrusions that oppose each other; and a pair of recesses that oppose each other, each recess being positioned between the pair of the protrusions.

9. The food waste disposal of claim 7, wherein water is removed from the ground food waste based on the second dewatering tub being rotated within the first dewatering tub while both the first opening and the second opening face upward, and wherein the water removed from the ground food waste is discharged based on the second dewatering tub being rotated while the first dewatering tub is rotated downward at a prescribed angle.

10. The food waste disposal of claim 1, further comprising a hot air supplying part configured to supply hot air into the dewatering part.

11. The food waste disposal of claim 1, further comprising an agitator that is configured to agitate the food waste and that is rotationally provided within the dewatering part.

12. The food waste disposal of claim 11, wherein the dewatering part comprises:

a first dewatering tub that is rotatably coupled to the connecting frame to rotate vertically downward away from the grinding part around the rotating shaft; and a second dewatering tub that is rotationally provided within the first dewatering tub, the second dewatering tub defining a plurality of dewatering holes on an outer circumferential surface of the second dewatering tub, the second dewatering tub being configured to receive the ground food waste, wherein the agitator is provided within the second dewatering tub.

13. The food waste disposal of claim 12, wherein the agitator comprises:

a bottom rib that, in use, extends radially outward from a center of a bottom surface of the second dewatering tub; and a lateral rib that, in use, extends from both end portions of the bottom rib along an inner circumferential surface of the second dewatering tub toward an opening of the second dewatering tub.

14. The food waste disposal of claim 13, wherein the lateral rib is curved at a prescribed angle.

15. The food waste disposal of claim 12, wherein the agitator is configured to be rotated in a direction equal to or different from a rotational direction of the second dewatering tub.

16. A food waste disposal comprising:

a grinding part configured to grind food waste;

a food waste dewatering part having an opening for receiving food waste from the grinding part and a drainage hole for discharging water from the food waste;

a connecting frame disposed over the dewatering part, the connecting frame having a communicating hole that is in communication with the opening of the dewatering part;

a rotating shaft coupled to the dewatering part; and a first motor configured to rotate the rotating shaft, wherein the dewatering part is configured to rotate in a top/bottom direction around the rotating shaft along a vertical plane by driving the first motor.

17. The food waste disposal of claim 16, wherein the dewatering part comprises:

a first dewatering tub that is rotatably coupled to the connecting frame to rotate around the rotating shaft along the vertical plane;

a second dewatering tub that is rotationally provided within the first dewatering tub, the second dewatering tub defining a plurality of dewatering holes on an outer circumferential surface of the second dewatering tub, the second dewatering tub being configured to receive the ground food waste and to discharge water out of the received food waste; and a second motor coupled to a bottom surface of the second dewatering tub to rotate the second dewatering tub, the second motor coupling to the second dewatering tub through a bottom surface of the first dewatering tub.

18. The food waste disposal of claim 17, further comprising a hot air supplying part configured to supply hot air into the dewatering part.

19. The food waste disposal of claim 18, wherein, based on the dewatering part being oriented in an upright position, the food waste disposal is configured to perform a dewatering operation of the food waste received in the dewatering part by rotating the second dewatering tub and perform a drying operation of the food waste by supplying hot air, and wherein, after the dewatering tub has been rotated around the rotating shaft, the food waste disposal is configured to perform a discharging operation of the food waste in the dewatering part.

20. The food waste disposal of claim 17, further comprising an agitator that is configured to agitate the food waste and that is rotationally provided within the dewatering part.

* * * * *